US005967417A

United States Patent [19]

Mantel

[11] Patent Number: 5,967,417

[45] Date of Patent: Oct. 19, 1999

[54] SHOWER HEAD

[75] Inventor: Ralf Mantel, Gutach, Germany

[73] Assignee: Hans Grohe GmbH & Co. KG, Germany

[21] Appl. No.: 08/951,566

[22] Filed: Oct. 16, 1997

[30] Foreign Application Priority Data

Oct. 19, 1996 [DE] Germany ..... 196 43 199

[51] Int. Cl.[6] ..... B05B 1/34

[52] U.S. Cl. ..... 239/380; 239/381; 239/99; 239/444; 239/447

[58] Field of Search ..... 239/99, 380, 381, 239/382, 383, 444, 446, 447

[56] References Cited

U.S. PATENT DOCUMENTS

| | | | |
|---|---|---|---|
| 3,801,019 | 4/1974 | Trenary et al. | 239/381 |
| 4,101,075 | 7/1978 | Heitzman | 239/101 |
| 4,141,502 | 2/1979 | Grohe | 239/381 |
| 4,190,207 | 2/1980 | Fienhold et al. | 239/381 |
| 4,239,409 | 12/1980 | Osrow . | |
| 4,629,125 | 12/1986 | Liu . | |
| 5,397,064 | 3/1995 | Heitzman | 239/99 |
| 5,577,664 | 11/1996 | Heitzman | 239/99 |
| 5,647,537 | 7/1997 | Bergmann | 239/383 |
| 5,718,380 | 2/1998 | Schorn et al. | 239/381 X |

FOREIGN PATENT DOCUMENTS

| | | |
|---|---|---|
| 4113289 | 11/1991 | Germany . |
| 4428788 | 2/1996 | Germany . |
| 62-12353 | 9/1986 | Japan . |

*Primary Examiner*—Andres Kashnikow
*Assistant Examiner*—Robin O. Evans
*Attorney, Agent, or Firm*—Duane, Morris & Heckscher LLP

[57] ABSTRACT

A shower head, for example, a hand shower contains in its interior a means with which the flow of the water leaving the shower head through a jet orifice can be modulated relatively slowly. The means for modulating the flow of water may be powered, more particularly, by a turbine wheel arranged in the interior of the shower head. When two arrays of jet orifices are provided for producing two different types of jet the means may be used for automatic changeover between the two types of jet. The invention provides a shower with which the user is showered by all types of jet possible with the aid of the shower without requiring him to make a change by hand.

9 Claims, 1 Drawing Sheet

SHOWER HEAD

BACKGROUND OF THE INVENTION

The invention is based on a shower having a shower head from which a jet of water emerges through at least one jet orifice of a jetting disk. Shower heads of this kind are known as head showers, hand showers and also as side showers.

Means are known in conjunction with shower heads for manually selecting several kinds of jets, for example, a hard jet and an aerated, more softer jet of water. For this purpose selectors are provided on the shower head, for example, a selector lever.

Known furthermore are massage showers in which a jet of water is interrupted at a high frequency by an element arranged in the shower head. The resulting jet thus consists of a sequence of short jets, the interruptions being, however, so short that the user is unable to discern the switching actions.

A shower head is also known which has automatic cleaning means in which cleaning fingers are thrust into the jet orifices by a turbine.

SUMMARY OF THE INVENTION

The invention is based on the object of providing a shower having improved response to use.

To achieve this object the invention proposes a shower head comprising a housing, a water inlet leading into the housing, a jetting disk including at least one jet orifice, a water guide for guiding the water from the water inlet to at least one jet orifice, as well as an automatic operating means for cyclically modulating the flow of the water jetted from at least one jet orifice. Further aspects of the invention are also disclosed.

Unlike known massage jets in the shower head in accordance with the invention a smooth reduction and subsequent reincrease in the flow of water emerging is caused, this reduction and/or reincrease being so slow that the user is able to both see and feel this effect. For example, a reduction in the cross-section from a fully open position to a minimally open position and back occurs, the duration of such an action being in a matter of seconds.

In one aspect of the invention it may be provided for that the shower head comprises two arrays of at least one jet orifice each, a separate water guide being provided for both arrays of jet orifices. In this case, as proposed by the invention, the flow modulator may be configured such that it switches to and fro between the two arrays of jet orifices. In the aforementioned example of a shower having a hard and an aerated soft jet the flow modulator can thus make the change between the two types of jet in a matter of seconds.

One possibility of varying the flow of the emerging water consists of arranging a restrictor in the water guide to the jet orifice and/or to the array of jet orifices, this restrictor varying more particularly the effective cross-section of the assigned water guide.

The drive for the flow modulator may be derived, more particularly, from the flowing water, for example, by exploiting the temperature of the shower water which as a rule is higher than the ambient temperature by means of a Peltier element to obtain an electric voltage with which an electric motor can be powered, causing the cross-section to be varied.

It is particularly of advantage, however, when, as is likewise provided for by the invention, the flow modulator comprises a turbine wheel which is mechanically geared to the restrictor. In this way the cross-section can be varied by a simple configuration even when the water is cold.

More particularly, it may be provided for that the restrictor comprises two parts provided movable relative to each other, each having at least one port, these parts being juxtaposed at least in the region of the ports. In this arrangement the effective cross-section of the water guide is determined by the common projection of the two ports in their plane of contact. When the parts are shifted so that the ports no longer coincide the effective cross-section of the water guide is then varied down to zero.

More particularly it may be provided for furthermore that both parts movable relative to each other are configured as disks, more particularly as flat disks, of which at least one is configured rotatable.

This rotation is a shape suitable for a shower head usually having a circular cross-section, providing both a simple means of modulation and also a large surface area.

More particularly the flow modulator may be configured such that in reducing the effective cross-section of the one water guide it increases the effective cross-section of the other water guide. In this way the changeover between the two water guides and thus the two arrays of jet orifices occurs gradually, as a result of which a particularly pleasant effect is achieved, especially when the changeover is made between a hard jet and the soft aerated jet. It may be provided for more particularly that the changeover in the one direction occurs faster than the changeover in the other direction.

In yet a further aspect it may be provided for that the two arrays of jet orifices are arranged concentrically and one of the two disks comprises a port for each of the two water guides oriented circumferentially.

BRIEF DESCRIPTION OF THE DRAWINGS

Further features, details and benefits read from the claims worded with respect to the contents of the description, from the following description of a preferred embodiment of the invention as well as from the drawing in which:

DETAILLED DESCRIPTION

Figure 1:
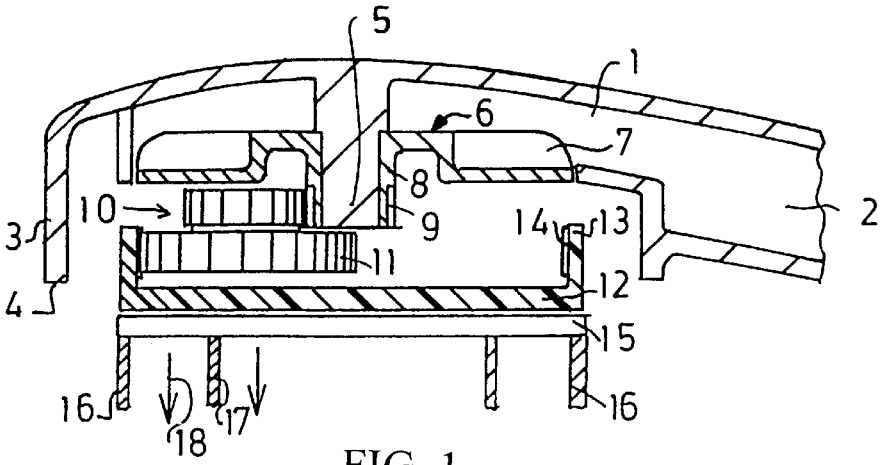
FIG. 1 is a greatly simplified schematic cross-section through a shower head in accordance with the invention depicted only in part.

To simplify appreciation the section as shown in FIG. 1 depicts only a few parts of the shower head, which in this case is a hand shower. The head shower contains a housing of which only the housing part 1 is illustrated. Leading into the housing from the right as shown in FIG. 1 is a water inlet which may be formed, for example, by the interior of a hollow handle.

The illustrated housing part 1 comprises a cicular cylindrical shell 3 having a free face edge 4 forming an opening. In assembling the head shower a jetting disk, for example, is inserted in this opening, this jetting disk comprising a plurality of jet orifices.

In the axis of the cylindrical shell 3, formed on the inner side of the illustrated housing part 1 is a shaft 5 on which a turbine wheel 6 is rotatably mounted. The turbine wheel 6 comprises individual vanes 7 which are caused to rotate by the water entering through the water inlet 2. The water then flows past the turbine wheel 6 and from there through the jet orifices of the jetting disk outwards.

On the outer side of its hub 8 the turbine wheel 6 comprises a toothing 9 located axially underneath the turbine wheel 6. Mating with the toothing 9 of the hub 8 is a gearwheel 10. This gearwheel 10 comprises two rim gears, of which the rim gear having the smaller diameter mates with the toothing 9 of the hub 8 of the turbine wheel 6.

Arranged rotatably mounted coaxially to the shaft 5 in the housing of the shower head is a first disk element 12, this disk element being mounted rotatable about the same axis as the turbine wheel 6. The disk element 12 comprises on its flat side facing the turbine wheel 6 an apron 13 arranged along its circumference. On its radial inner side the apron 13 features a toothing 14. Mating with this toothing 14 is the outer toothing of the larger rim gear 11 of the gearwheel 10. Accordingly, rotation of the turbine wheel results in rotation of the disk element 12.

Arranged directly beneath the rotatable disk element 12 locked in place in the housing of the head shower is a second disk element 15 which is circumferentially sealed off from the housing.

Illustrated in FIG. 1 beneath the second disk element, i.e. downstream of the disk element 15 as viewed in the direction of flow are two separate water guides formed by coaxial cylinders 16, 17 indicated schematically and their directions indicated by the arrows 18 which lead to the assigned arrays of jet orifices of the jetting disks. For example, the water guide in the space between the two cylinders 16, 17 leads to an outer ring of jet orifices producing a relatively hard jet of water. The water guide within the inner cylinder 17 may then lead to an aerated jet.

In FIG. 1 the spacing between the two disk elements 12, 15 is depicted magnified.

Figure 2:
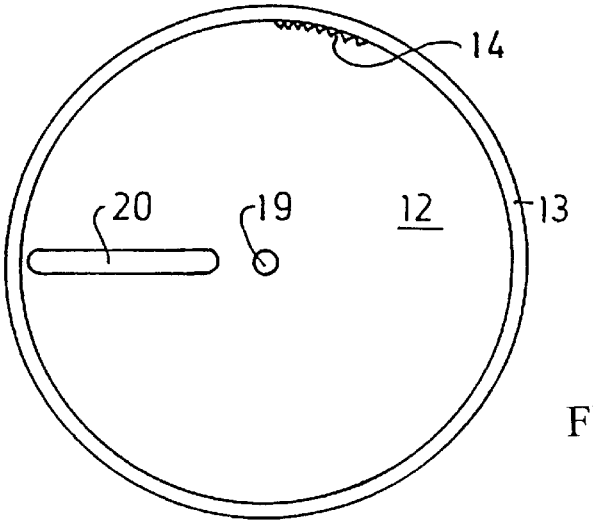
FIG. 2 is a top view of a rotatable disk of the shower head as shown in FIG. 1.

FIG. 2 shows the disk element 12 of the shower as shown in FIG. 1 as viewed from above, i.e. the disk element 12 first met with in the direction of flow. Provided in the centerpoint thereof is an opening 19 which serves to mount the disk element 12. The toothing 14 on the inner side of the apron 13 is illustrated in the drawing only in the upper region, it extending, however, over the full inner circumference of the apron 13.

At a position along a radius the disk element 12 features in its disk portion a port 20 having everwhere roughly the same width, it only being through this port 20 of the disk element 12 that the water flowing past the turbine wheel 6 is able to gain further access.

Figure 3:
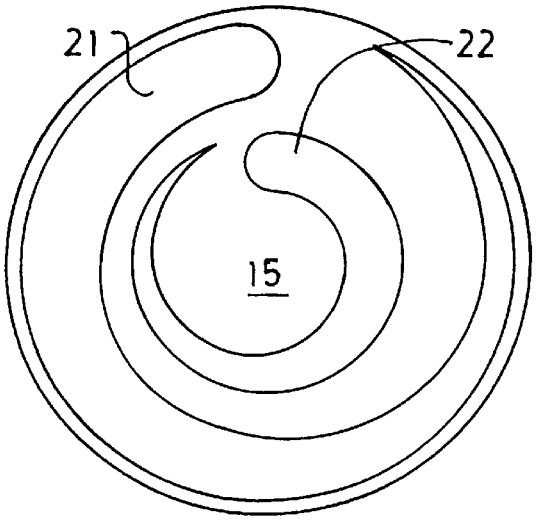
FIG. 3 is a top view of a fixed disk forming part of the shower head.

FIG. 3 is a view from above on the second disk element 15 which in the direction of flow directly follows the first disk element 12. The disk element 15, i.e. the fixed disk element, comprises a first port 21 extending over almost all of the complete circumference and which as viewed from above is located totally in the space between the two cylinders 16, 17. As viewed circumferentially the width of this port 21, as measured radially, is continuously reduced counterclockwise as shown in FIG. 3.

The fixed disk element 15 comprises a second port 22 which likewise extends circumferentially and is arranged totally within the inner cylinder 17. The width of this second port is likewise continually reduced as measured radially, i.e. in the opposite sense of rotation relative to that of the port 21 of the disk element 15.

In any position of the rotatable disk element 12 within the shower head the water can only flow through the port 20 to the ports 21 and 22. Since the two disk elements 12, 15 are intimately connected at least in the region of their ports, the porting cross-section is dictated by the coinciding portion between the port 20 and the port 21 or between the port 20 and the port 22. It will be appreciated that depending on the position of the disk element 12 the coinciding width differs. In this way the effective cross-section depends on the angular position of the rotatable disk 12 relative to the fixed disk 15. Accordingly, with continual rotation of the rotatable disk element 12 relative to the fixed disk element 15, for instance, the flow of water between the cylinders 16 and 17 is reduced whilst the flow of water through the inner cylinder is continuously increased.

Assuming that the disk as seen from above in FIG. 2 is turning counterclockwise, then the water flowing through the annular space between the cylinders 16, 17 is continually reduced down to zero and then suddenly reverses to its full value. The water flowing through the inner cylinder 17 increases continually until it attains a maximum, upon which it abruptly drops to zero.

By changing the shape of the ports 21, 22 and, where necessary, of the port 20 too, differing patterns in reducing and increasing the flow of water emerging from the two arrays of jet orifices can be achieved.

Depending on how the disks are configured several types of jets can be selected or varied.

To maintain a preferred type of jet or combination thereof an arrester is provided with which the actuator or turbine can be halted, this arrester being likewise suitable to decelerate the rate of modulation.

We claim:

1. A shower head comprising:

a housing with a water inlet leading into the housing, a jetting disk having at least one jet orifice therein, a water guide for guiding water from said water inlet to said at least one jet orifice;

an automatic operating means for cyclically modulating flow of water jetted from said at least one jet orifice; and, wherein two arrays of jet orifices and a water guide are provided, leading to each array respectively, and wherein the means for cyclically modulating the flow is configured to switch to and fro between the two arrays of jet orifices.

2. The shower head as set forth in claim 1, wherein said means for cyclically modulating the flow is configured such that in reducing an effective cross-section of one said water guide, it increases that of the other said water guide.

3. The shower head as set forth in claim 1, further comprising a restrictor inserted in said water guide.

4. The shower head as set forth in claim 3, wherein said means for cyclically modulating the flow is motor powered.

5. The shower head as set forth in claim 4, wherein said means for cyclically modulating the flow is water powered.

6. The shower head as set forth in claim 5, wherein said means for cyclically modulating the flow comprises a turbine wheel geared to said restrictor.

7. The shower head as set forth in claim 3, wherein said restrictor comprises two parts that are movable relative to each other, each of said parts having at least one port, a total projection surface of said parts defining a cross-section of said water guide.

8. The shower head as set forth in claim 7, wherein both said parts comprise flat disks and at least one of the disks is rotatable.

9. The shower head as set forth in claim 8, wherein said two arrays of jet orifices are arranged concentrically and at least one of said two disks comprises a port oriented in direction of movement for each said water guide, respectively.

* * * * *